US008893384B2

(12) United States Patent
Yang et al.

(10) Patent No.: US 8,893,384 B2
(45) Date of Patent: Nov. 25, 2014

(54) HEAT PIPE MANUFACTURING METHOD

(75) Inventors: Hsiu-Wei Yang, New Taipei (TW); Ming-Tai Weng, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 432 days.

(21) Appl. No.: 13/170,548

(22) Filed: Jun. 28, 2011

(65) Prior Publication Data

US 2013/0000122 A1 Jan. 3, 2013

(51) Int. Cl.

*B23P 6/00* (2006.01)
*F28D 15/02* (2006.01)
*F28D 15/04* (2006.01)

(52) U.S. Cl.

CPC ..... *F28D 15/0233* (2013.01); *F28D 15/046* (2013.01); *F28D 15/0283* (2013.01)
USPC ..... 29/890.032

(58) Field of Classification Search

CPC ..... F28D 15/046; F28D 15/0283
USPC ..... 29/890.032
See application file for complete search history.

(56) References Cited

U.S. PATENT DOCUMENTS

| | | | | |
|---|---|---|---|---|
| 6,427,765 | B1 * | 8/2002 | Han et al. | 165/104.26 |
| 2006/0174484 | A1 * | 8/2006 | Chuang et al. | 29/890.032 |
| 2010/0083500 | A1 * | 4/2010 | Lin et al. | 29/890.03 |
| 2010/0307003 | A1 * | 12/2010 | Hoffman et al. | 29/890.032 |
| 2012/0048516 | A1 * | 3/2012 | He et al. | 165/104.26 |

* cited by examiner

*Primary Examiner* — Moshe Wilensky

(57) ABSTRACT

A heat pipe manufacturing method includes the steps of preparing a pipe and a wick structure; placing the wick structure in the pipe, vacuuming the pipe, and filling a working fluid in the pipe; and sealing the pipe. By manufacturing a heat pipe with this method, the risk of damaging the wick structure in the pipe during bending or pressing the pipe can be avoided to thereby ensure increased good yield. Further, with this method, the pipe can be pressed to form a thin heat pipe to thereby provide increased flexibility in production.

7 Claims, 6 Drawing Sheets

HEAT PIPE MANUFACTURING METHOD

FIELD OF THE INVENTION

The present invention relates to a heat pipe manufacturing method, and more particularly to a heat pipe manufacturing method, with which a wick structure is pre-produced outside a pipe and then placed in the pipe to ensure good yield of heat pipe and enable the forming of thin heat pipe.

BACKGROUND OF THE INVENTION

With the highly increased operating speed of the electronic elements in the currently available electronic products, more heat is generated by the electronic elements during operation thereof. The generated heat must be timely removed from the electronic products, lest it should adversely affect the stable operation of a central processing unit (CPU) of the electronic products. In other words, it is very important to adequately dissipate the heat generated by heat-generating electronic elements.

Heat sink is one of the most frequently devices for dissipating heat generated by electronic elements. In the early stage, a heat sink is usually integrally formed by way of aluminum extrusion, and includes a base and a plurality of radiating fins extended from one side of the base. When using this type of heat sink to dissipate heat, the base of the heat sink is tightly attached to a heat-generating electronic element, and a cooling fan is further mounted on the heat sink as an auxiliary means to help dissipate the heat from the heat sink.

However, since the amount of heat generated by the electronic elements quickly increased in recently years, the conventional heat sink can hardly meet the current requirement for heat dissipation. Therefore, heat sinks with increased heat dissipation area have been developed to provide upgraded heat dissipation ability. However, heat sinks with increased heat dissipation area inevitably have increased weight and volume to occupy largely increased space, which obviously has adverse influence on the development of compact electronic products.

Therefore, heat pipe is also employed in the electronic industry as a heat transfer element. The heat pipe is extended through a set of radiating fins and a low boiling point working fluid is filled in the heat pipe. The working fluid is vaporized in the heat pipe at a vaporizing end thereof in contact with a heat-generating electronic element, and the vapor-phase working fluid flows from the vaporizing end to an opposite condensing end of the heat pipe extended through the radiating fins, so that the heat generated by the electronic element is transferred to the radiating fins. A cooling fan is also used to produce airflow for carrying the heat away from the radiating fins to achieve the purpose of removing the heat generated by the electronic element.

In manufacturing the heat pipe, a type of metal powder is filled in a hollow pipe. The metal powder is sintered to form a wick structure on an inner wall surface of the hollow pipe. Thereafter, the pipe is vacuumed and filled with a working fluid before being sealed. And, to meet the demands for low-profile electronic devices, the heat pipe is usually further processed to form a thin heat pipe.

To form the thin heat pipe, first sinter the filled metal powder and then press the heat pipe into a flat configuration. Thereafter, after filling the working fluid, the heat pipe is sealed. Alternatively, the hollow pipe of the heat pipe can be pressed into a flat configuration before the filled metal powder is sintered. However, in the latter case, since the flattened hollow pipe defines a very narrow chamber therein, which not only causes difficulty in filling the metal powder into the hollow pipe, but also results in an extremely narrow vapor channel in the heat pipe to thereby have adverse influence on the vapor-liquid circulation in the heat pipe.

In brief, the conventional heat pipe manufacturing methods have the following disadvantages: (1) uneasy to form a thin heat pipe; (2) tending to damage the wick structure in the heat pipe; and (3) requiring relatively high manufacturing cost.

SUMMARY OF THE INVENTION

A primary object of the present invention is to provide a heat pipe manufacturing method, with which a wick structure in the heat pipe is protected against compression and damage in the manufacturing process.

Another object of the present invention is to provide a heat pipe manufacturing method, with which a thin heat pipe can be produced.

To achieve the above and other objects, the heat pipe manufacturing method according to the present invention includes the following steps:

preparing a pipe and a wick structure;

placing the wick structure in the pipe, vacuuming the pipe, and filling a working fluid in the pipe; and sealing the pipe to complete a heat pipe.

With the heat pipe manufacturing method according to the present invention, it is able to avoid the problem of damaging the wick structure in the pipe during the heat pipe manufacturing process, and a thin heat pipe can be more easily manufactured. Therefore, the problems of damaged wick structure and high manufacturing cost as found in the conventional heat pipe structure can be effectively solved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
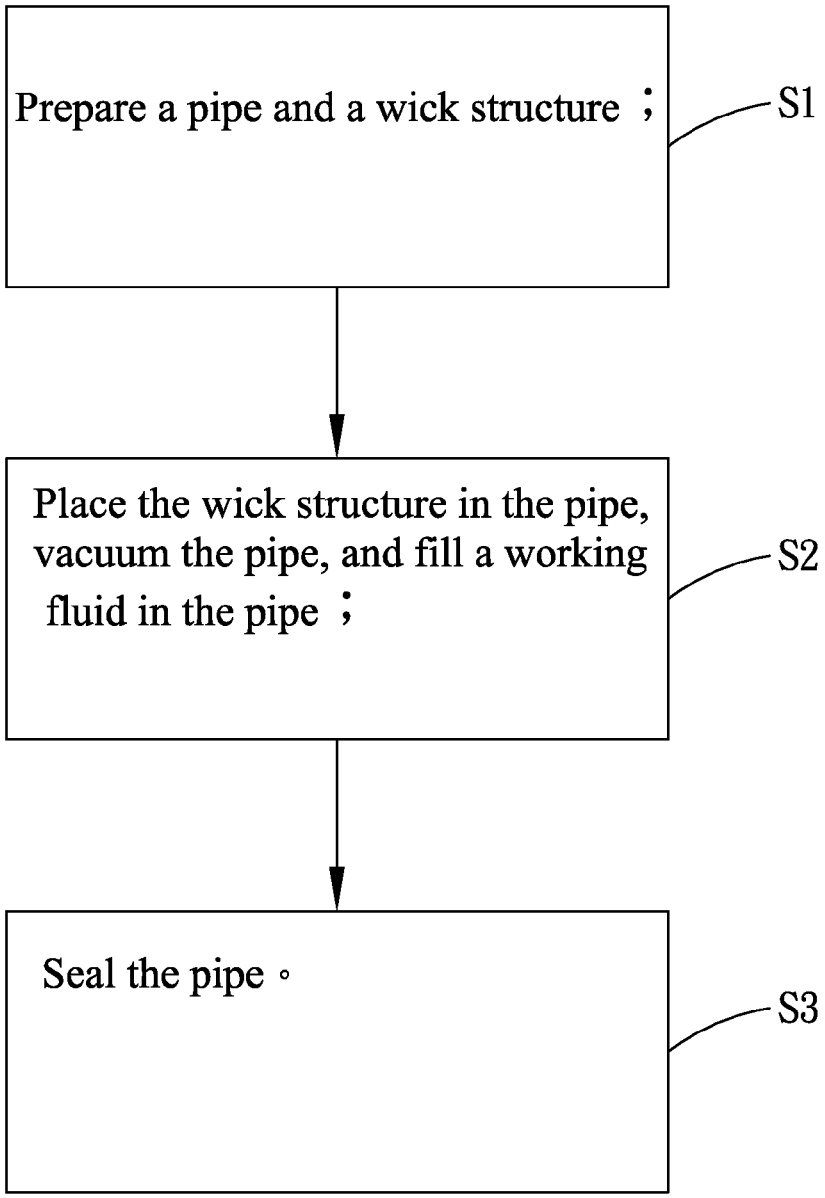
FIG. 1 is a flowchart showing the steps included in the heat pipe manufacturing method according to a first embodiment of the present invention.

The present invention will now be described with some preferred embodiments thereof and with reference to the accompanying drawings. For the purpose of easy to understand, elements that are the same in the preferred embodiments are denoted by the same reference numerals.

FIG. 1 is a flowchart showing steps S1, S2, and S3 included in a heat pipe manufacturing method according to a first embodiment of the present invention. Please refer to FIG. 1 along with FIGS. 4, 5, 6 and 7.

In the step S1, a pipe and a wick structure are prepared.

Figure 4:
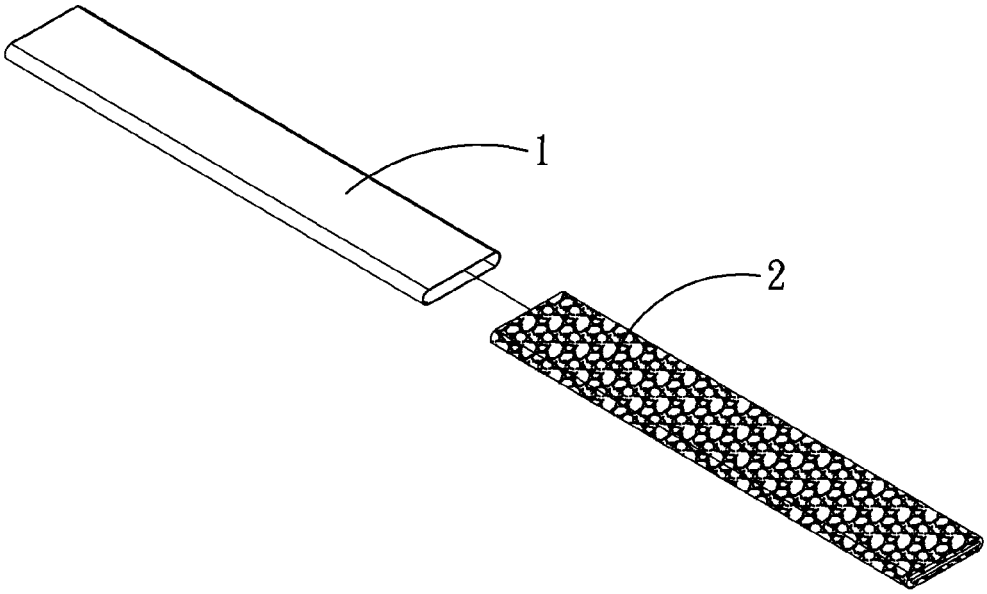
FIG. 4 is an exploded perspective view of a heat pipe manufactured using the method of the present invention.
Figure 5:
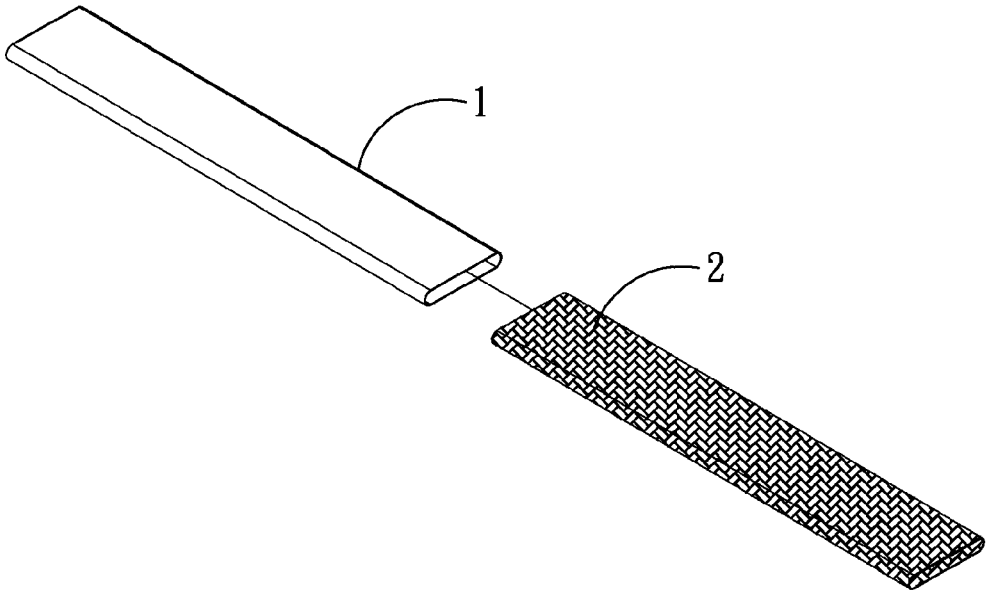
FIG. 5 is an exploded perspective view of another heat pipe manufactured using the method of the present invention.
Figure 7:
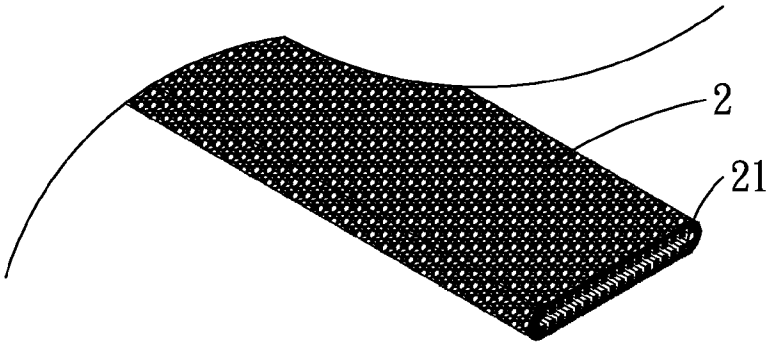
FIG. 7 is a perspective view of another wick structure for heat pipe manufactured using the method of the present invention.
Figure 6:
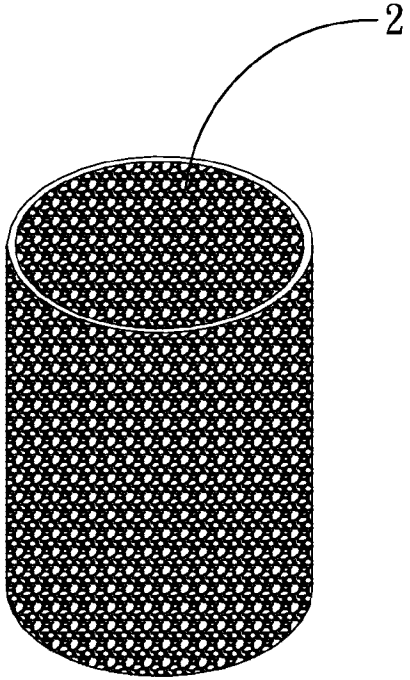
FIG. 6 is a perspective view of a wick structure for heat pipe manufactured using the method of the present invention.

More specifically, in the step S1, a hollow metal pipe 1 and a wick structure 2 formed by sintering a type of metal powder are prepared. The pipe 1 can be made of a metal material having good thermal conductivity, such as copper or aluminum. In the illustrated first embodiment, the pipe is a flat pipe 1. While the wick structure 2 illustrated in the first embodiment is in the form of sintered metal powder as shown in FIG. 4, it can be otherwise in the form of a net-like body as shown in FIG. 5. In the case of a wick structure 2 formed of sintered metal powder, the metal powder can be copper powder or aluminum powder. The wick structure 2 is formed into a shape corresponding to a configuration of a hollow space in the pipe 1, such as an annular wick structure 2 as shown in FIG. 6 or a hollow flat wick structure 2 as shown in FIGS. 4 and 5. Alternatively, the hollow flat wick structure 2 can be further provided on inner wall surfaces with a plurality of grooves 21, as shown in FIG. 7.

In the step S2, the wick structure is placed in the hollow pipe, the hollow pipe is vacuumed, and a working fluid is filled in the vacuumed pipe.

More specifically, in the step S2, the wick structure 2 is placed in the hollow pipe 1 in a tight-fit manner, so that the wick structure 2 is more securely associated with the pipe 1. Then, the pipe 1 is vacuumed and a working fluid is filled in the vacuumed pipe 1.

In the step S3, the pipe is sealed.

More specifically, in the step S3, after the pipe 1 is vacuumed and filled with the working fluid, an open end of the pipe 1 is sealed.

Figure 2:
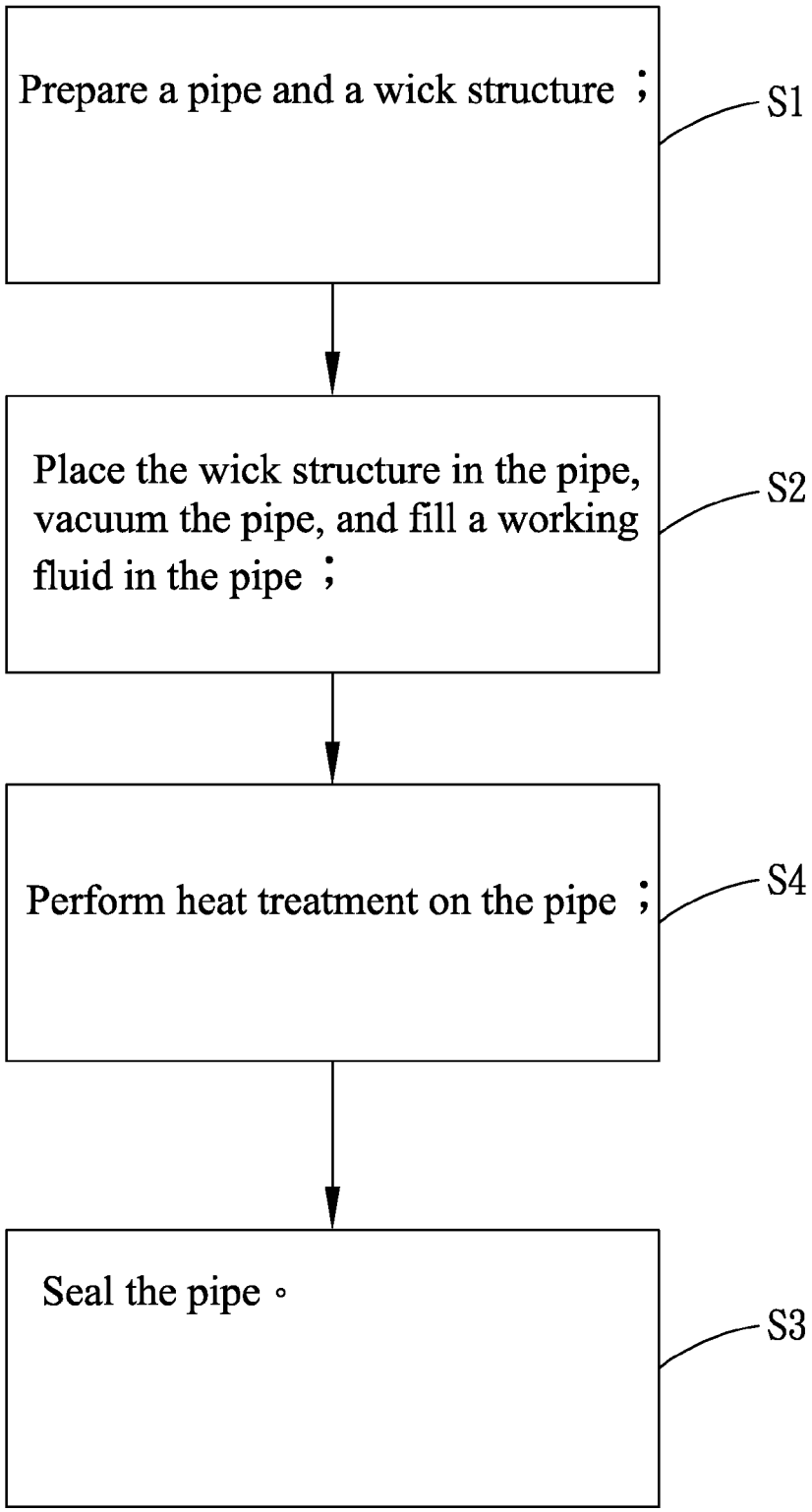
FIG. 2 is a flowchart showing the steps included in the heat pipe manufacturing method according to a second embodiment of the present invention.

FIG. 2 is a flowchart showing steps S1, S2, S4 and S3 included in a heat pipe manufacturing method according to a second embodiment of the present invention. Please refer to FIG. 2 along with FIGS. 4, 5, 6 and 7.

Since the steps S1, S2 and S3 in the second embodiment are the same as those in the first embodiment, they are not repeatedly described herein. As to the step S4, it is performed before the step S3. In the step S4, the pipe is subjected to heat treatment.

More specifically, in the step S4, after the wick structure 2 is placed in the hollow pipe 1 and the hollow pipe 1 is vacuumed and filled with the working fluid, the pipe 1 is subjected to heat treatment to ensure tight binding of the wick structure to the pipe 1. The heat treatment is diffusion bonding. That is, by way of heating, the wick structure 2 and the pipe 1 are tightly connected to each other to form an integral unit and eliminate any clearance therebetween.

Figure 3:
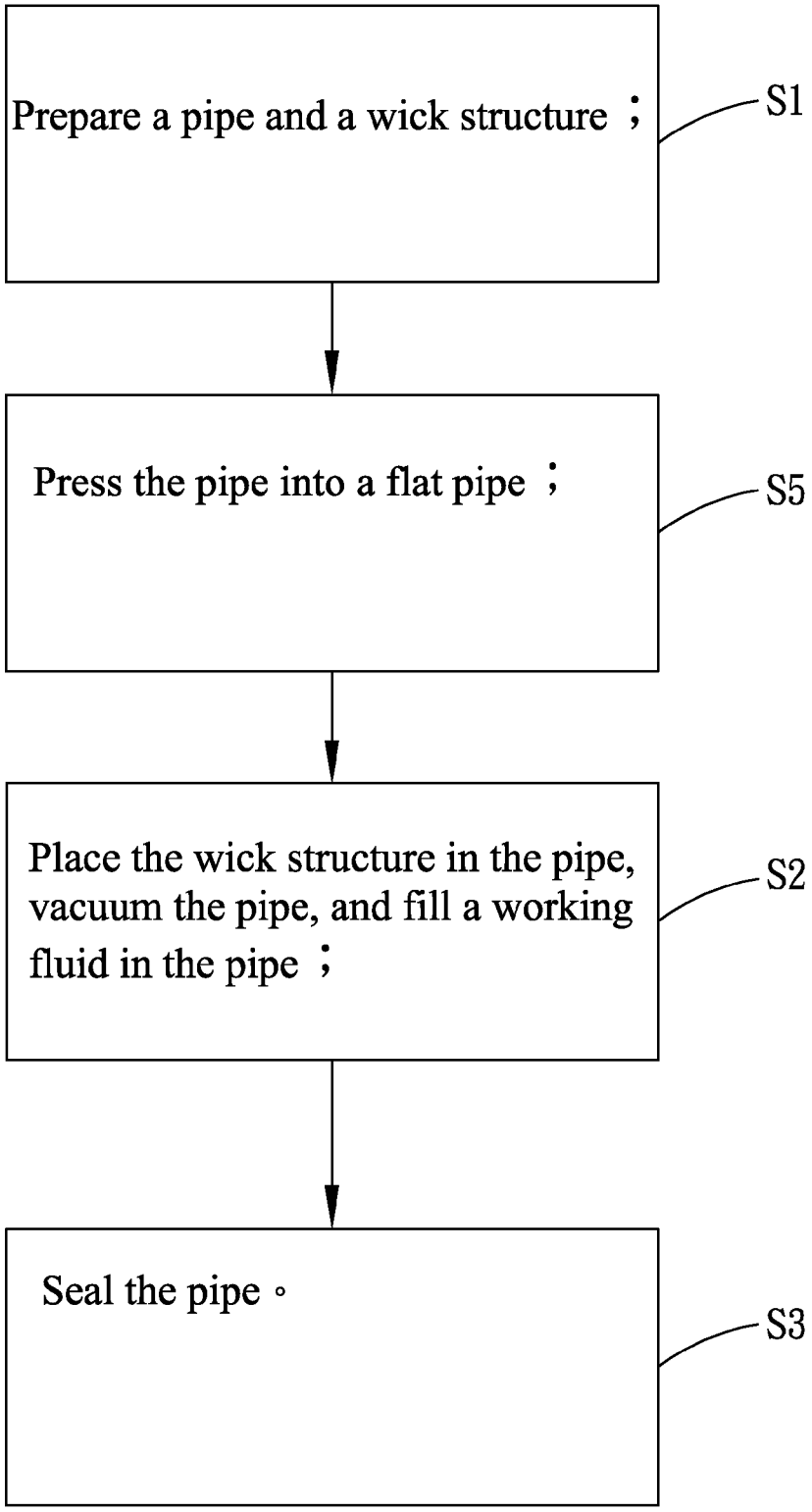
FIG. 3 is a flowchart showing the steps included in the heat pipe manufacturing method according to a third embodiment of the present invention.

FIG. 3 is a flowchart showing steps S1, S5, S2 and S3 included in a heat pipe manufacturing method according to a third embodiment of the present invention. Please refer to FIG. 3 along with FIGS. 4, 5, 6 and 7.

Since the steps S1, S2 and S3 in the third embodiment are the same as those in the first embodiment, they are not repeatedly described herein. As to the step S5, it is performed before the step S2. In the step S5, the pipe is pressed into a flat pipe.

Figure 9:
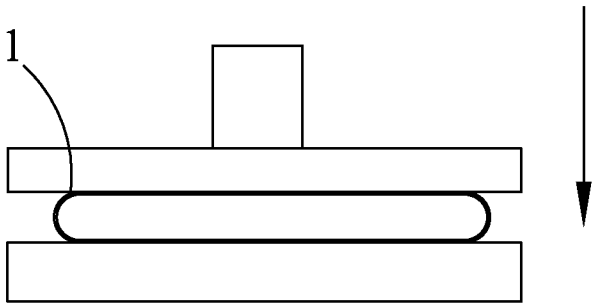
FIGS. 8 and 9 schematically show the forming of a thin heat pipe according to the method of the present invention.
Figure 8:
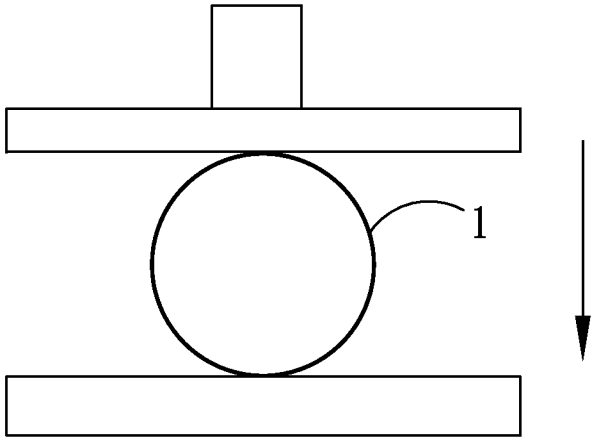

More specifically, in the case a thin heat pipe is required, in the step S5, the pipe 1 is pressed into a flat form. In the third embodiment of the present invention, the pipe 1 can be flattened by way of, but not limited to, stamping, as shown in FIGS. 8 and 9.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A method of manufacturing a heat pipe, comprising the following sequence:

preparing a pipe;

pre-assembling a wick structure;

placing the pre-assembled wick structure in the pipe, vacuuming the pipe, filling a working fluid in the pipe; and performing diffusion bonding heat treatment on the pipe to achieve increased binding of the wick structure to the pipe; and sealing the pipe.

2. The heat pipe manufacturing method as claimed in claim 1, wherein the wick structure is a net-like body.

3. The heat pipe manufacturing method as claimed in claim 1, wherein the wick structure is a type of sintered powder.

4. The heat pipe manufacturing method as claimed in claim 3, wherein the sintered powder is selected from the group consisting of sintered copper powder and sintered aluminum powder.

5. The heat pipe manufacturing method as claimed in claim 1, wherein the pipe is a flat pipe.

6. The heat pipe manufacturing method as claimed in claim 1, further comprising a step before the step of placing the wick structure in the pipe: pressing the pipe into a flat pipe.

7. The heat pipe manufacturing method as claimed in claim 6, wherein the pipe is pressed into a flat pipe by way of stamping.

* * * * *